US011611185B2

(12) United States Patent
Mathews et al.

(10) Patent No.: US 11,611,185 B2
(45) Date of Patent: Mar. 21, 2023

(54) TOOL FOR TREATING A SEAL WIPING SURFACE OF A SEALED CONNECTOR

(71) Applicant: Aptiv Technologies Limited, St. Michael (BB)

(72) Inventors: Thomas Mathews, Cortland, OH (US); Ignacio Reyes Mata, Saltillo (MX); Terry A. Morgan, Warren, OH (US); Terry A. George, Salem, OH (US); Sarah Guza, Boardman, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/585,767

(22) Filed: Jan. 27, 2022

(65) Prior Publication Data

US 2022/0149575 A1 May 12, 2022

Related U.S. Application Data

(62) Division of application No. 16/446,711, filed on Jun. 20, 2019, now Pat. No. 11,276,975.
(Continued)

(51) Int. Cl.
*H01R 43/00* (2006.01)
*C10M 107/38* (2006.01)
(Continued)

(52) U.S. Cl.
CPC ..... *H01R 43/005* (2013.01); *C10M 107/38* (2013.01); *C10M 107/50* (2013.01); *H01R 13/5202* (2013.01); *C10M 2213/0606* (2013.01); *C10M 2229/0425* (2013.01); *C10N 2040/17* (2020.05)

(58) Field of Classification Search
CPC ..... H01R 43/005; H01R 13/5219; H01R 13/5202; H01R 13/631; H01R 43/18; H01R 43/26; B05B 13/0627; B05B 1/306; B05B 7/0012; C10M 107/50; C10M 107/38; C10M 2213/0606; C10M 2229/0425; C10N 2040/17
See application file for complete search history.

(56) References Cited

U.S. PATENT DOCUMENTS 5,492,487 A 2/1996 Cairns et al.
6,500,027 B1 12/2002 Van et al.
(Continued)

FOREIGN PATENT DOCUMENTS

EP 2626141 A1 8/2013
JP 2000012183 A 1/2000
JP 2003187941 A 7/2003

OTHER PUBLICATIONS

European Office Action for EP Application No. 19180838.5, dated Apr. 6, 2021, 3 pages.

*Primary Examiner* — Vishal V Vasisth
(74) *Attorney, Agent, or Firm* — Billion & Armitage

(57) ABSTRACT

A tool configured to apply a lubricant includes an insert disposed within a shroud of an electrical connector. The insert has a central cavity and passages extending from the central cavity to portals defined in an outer surface of the insert and a spray valve disposed within the insert configured to dispense a lubricant mist into the central cavity, through the passages to the portals, and onto a seal wiping surface of the electrical connector.

15 Claims, 10 Drawing Sheets

Related U.S. Application Data

(60) Provisional application No. 62/688,423, filed on Jun. 22, 2018.

(51) Int. Cl.

| | |
|---|---|
| ***C10M 107/50*** | (2006.01) |
| ***H01R 13/52*** | (2006.01) |
| *C10N 40/14* | (2006.01) |

(56) References Cited

U.S. PATENT DOCUMENTS

| | | | | |
|---|---|---|---|---|
| 7,845,980 | B1 | 12/2010 | Amidon | |
| 8,100,716 | B2 | 1/2012 | Yahya et al. | |
| 2015/0001841 | A1 | 1/2015 | Oshima et al. | |
| 2019/0093659 | A1* | 3/2019 | Crum | F16N 7/34 |

* cited by examiner

TOOL FOR TREATING A SEAL WIPING SURFACE OF A SEALED CONNECTOR

CROSS-REFERENCE TO RELATED APPLICATION

This application is a divisional application under 35 U.S.C. § 120 of co-pending U.S. patent application Ser. No. 16/446,711, filed Jun. 20, 2019 now patent Ser. No. 11/276,975, which claims priority to U.S. Provisional Patent Application No. 62/688,423, filed Jun. 22, 2018, the entire disclosure of each of which is hereby incorporated by reference.

TECHNICAL FIELD OF THE INVENTION

The invention generally relates to sealed connectors, particularly to a method and a tool for treating a seal wiping surface of a sealed connector.

BRIEF SUMMARY OF THE INVENTION

According to one embodiment of the invention, a method of preparing a sealed connector system for connection is provided. The sealed connector system has a male connector body, a female connector body defining a shroud in which the male connector body is received, and a resilient seal axially surrounding a portion of the male connector body. The method incudes the steps of a) applying a lubricant on a seal wiping surface on the interior of the shroud and b) inserting the male connector body within the female connector body such that the resilient seal is in compressive contact with the seal wiping surface.

In an example embodiment having one or more features of the method of the previous paragraph, the lubricant is applied to the seal wiping surface using a spraying process.

In an example embodiment having one or more features of the method of the previous paragraph, step b) of the method also includes the step of disposing an insert within the shroud. The insert defines a central cavity and a plurality of passages extending from the central cavity to portals defined in an outer surface of the insert that are arranged adjacent to the seal wiping surface. The second step of the method also further includes disposing a spray valve disposed within the insert, dispensing the lubricant as a mist into the central cavity and through the plurality of passages to the portals, and depositing the lubricant mist onto the seal wiping surface of the shroud.

In an example embodiment having one or more features of the method of the previous paragraph, step b) is performed prior to initial insertion of the male connector body into the female connector body.

In an example embodiment having one or more features of the method of the previous paragraph, application of the lubricant is limited to the seal wiping surface.

In an example embodiment having one or more features of the method of the previous paragraph, the lubricant comprises a perfluoropolyether based lubricant.

In an example embodiment having one or more features of the method of the previous paragraph, the lubricant consists of a perfluoropolyether lubricant.

In an example embodiment having one or more features of the method of the previous paragraph, the lubricant comprises a phenylmethyl polysiloxane based lubricant.

In an example embodiment having one or more features of the method of the previous paragraph, the lubricant consists of a phenylmethyl polysiloxane lubricant.

According to one embodiment of the invention, tool configured for preparing a sealed connector system for connection is provided. The sealed connector system has a male connector body, a female connector body defining a shroud configured to receive the male connector body, and a resilient seal axially surrounding a portion of the male connector body. The tool includes an insert that is configured to be disposed within the shroud. The insert defines a central cavity and a plurality of passages extending from the central cavity to portals that are defined in an outer surface of the insert. The tool further includes a spray valve disposed within the insert configured to dispense a lubricant mist into the central cavity and through the plurality of passages to the portals. The portals are configured to deposit the lubricant mist onto a seal wiping surface of the shroud.

In an example embodiment having one or more features of the tool of the previous paragraph, the insert is configured to limit application of the lubricant to the seal wiping surface.

In an example embodiment having one or more features of the tool of the previous paragraph, the insert and spray valve are configured to accommodate a perfluoropolyether based lubricant.

In an example embodiment having one or more features of the tool of the previous paragraph, the insert and spray valve are configured to accommodate a phenylmethyl polysiloxane based lubricant.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
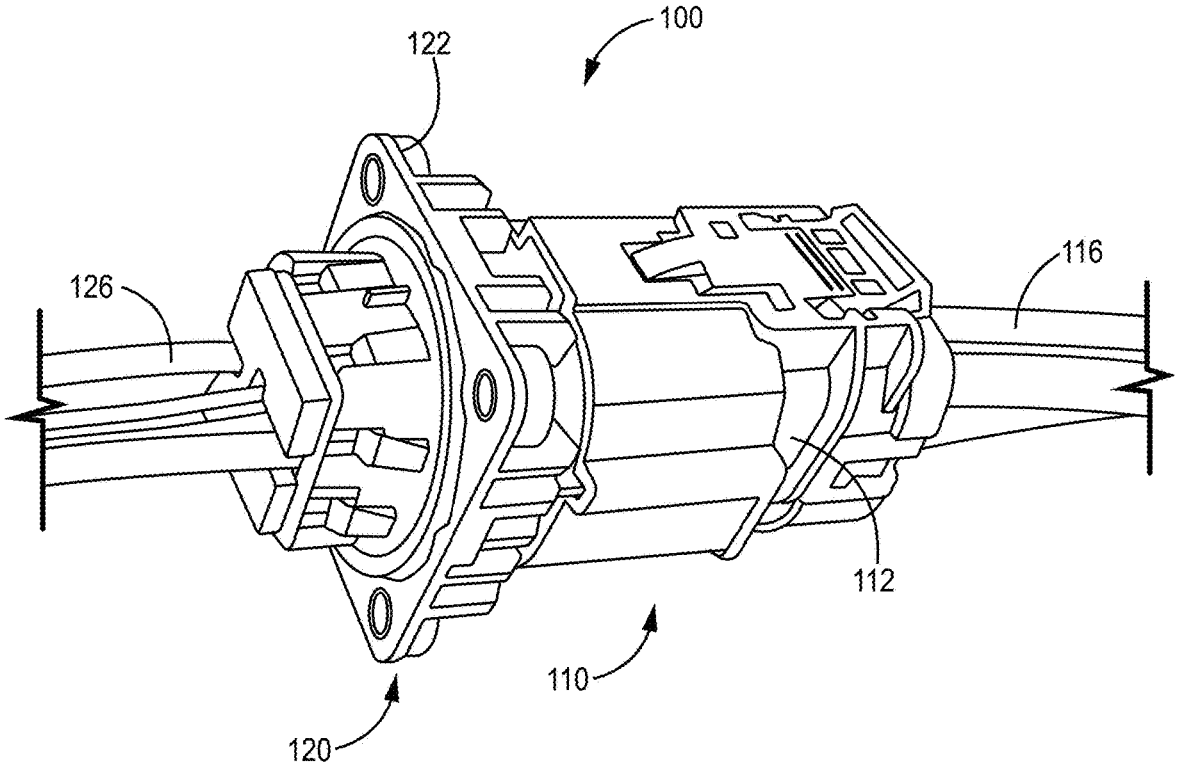
FIG. 1 is a perspective view of a sealed electrical connector assembly.
Figure 2:
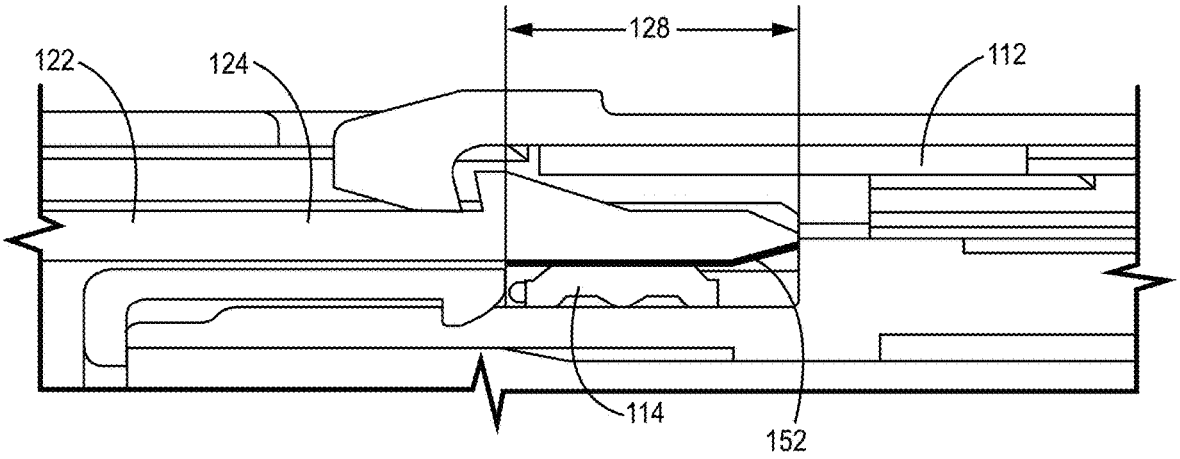
FIG. 2 is a cross section view of the view of the sealed electrical connector assembly of FIG. 1.

A sealed electrical connector assembly 100, such as the example shown in FIGS. 1 and 2, is used to interconnect electrical wiring harnesses in environments that could expose the electrical connections within the connector assembly to environmental contaminants, such as dust, dirt, water, or other fluids which could degrade the electrical connections in the connector assembly. The sealed electrical connector assembly 100 includes a male connector 110 having a male connector body 112, a resilient seal 114 axially surrounding a portion of the male connector body 112, and electrical terminals (not shown) terminating wire cables 116 secured within the male connector body 112. The sealed electrical connector assembly 100 also includes a female connector 120 having a female connector body 122 defining a shroud 124 configured to receive the male connector body 112 and mating electrical terminals (not shown) terminating wire cables 126 secured within the female connector body 122. The seal 114 is in compressive contact with a seal wiping surface 128 inside of the shroud 124 as the male connector body 112 is inserted within the female connector body 122.

Figure 3:
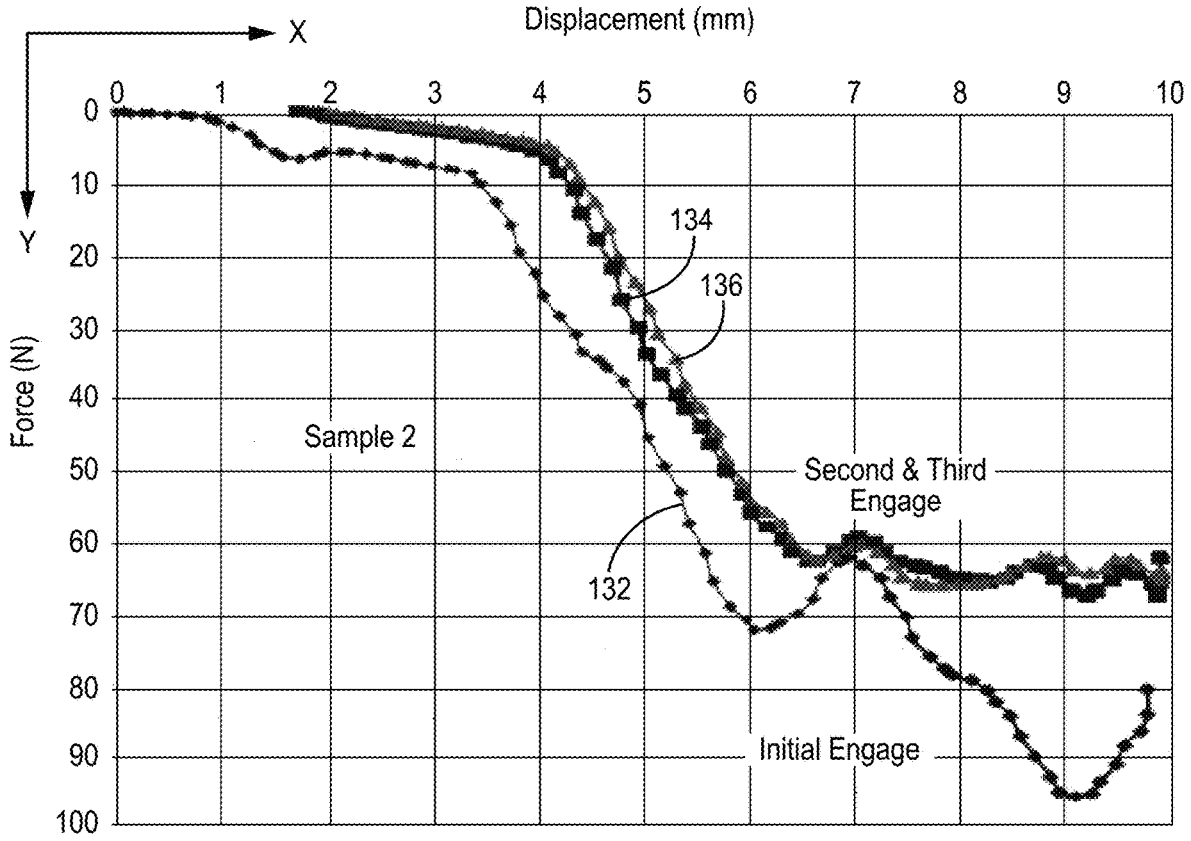
FIG. 3 is force-displacement diagram for three initial connections of the sealed electrical connector assembly of FIG. 1.
Figure 4:
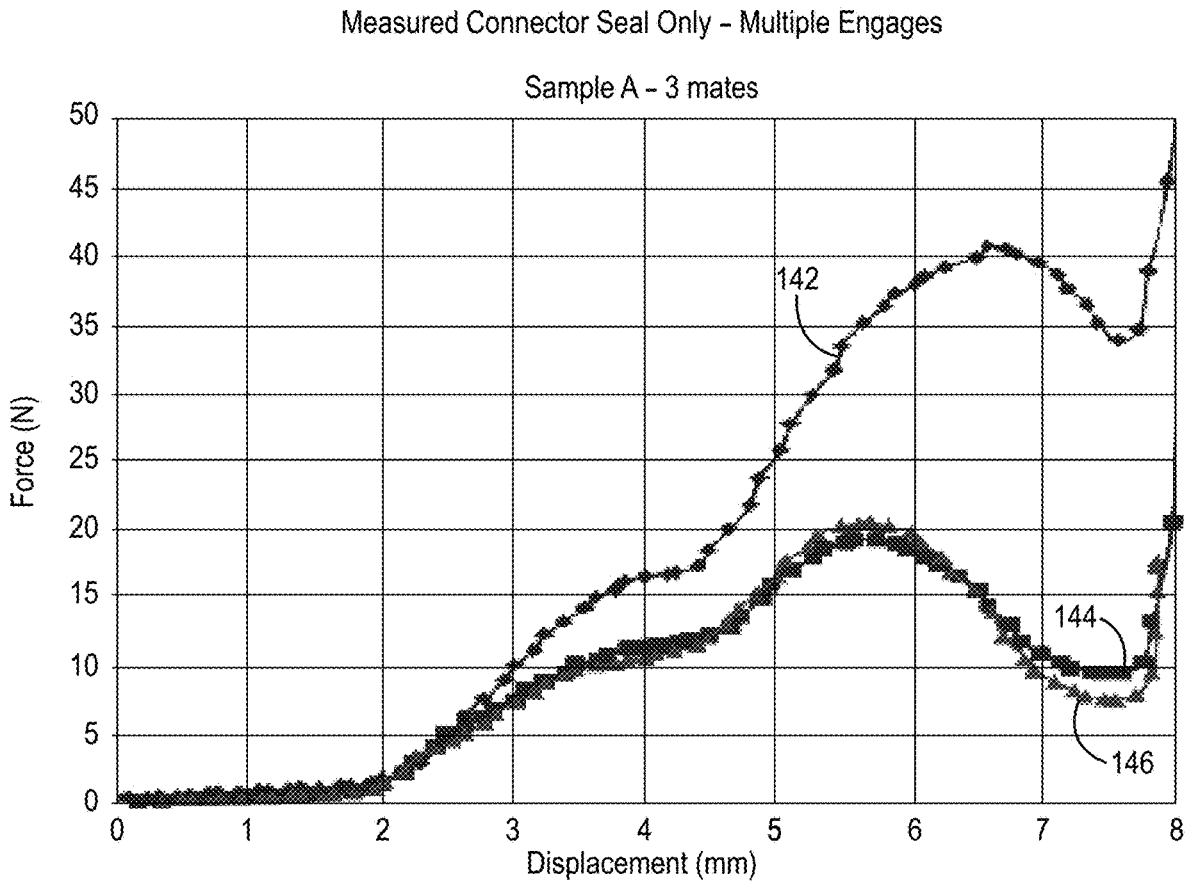
FIG. 4 is force-displacement diagram for three initial connections of the connector bodies and seal of the sealed electrical connector assembly of FIG. 1.

The inventors have observed that the force required for mating the male connector 110 with the female connector 120 is greater on the initial connection 132 of the sealed electrical connector assembly 100 than on subsequent connections 134, 136 as illustrated in the force-travel diagram of the sealed connector assembly in FIG. 3. The inventors have discovered that much of this change in mating force is due the reduction in the coefficient of friction between the seal wiping surface on the shroud and the seal. This is achieved by the transfer of oil from the seal to the seal wiping surface 128 on the initial connection 142, particularly if the seal 114 is formed of a high oil bleed connect silicone material as illustrated in the force-travel diagram of the initial connection 142 and subsequent connections 144, 146 of the male and female connector bodies 112, 122 and seal 114 connected without the electrical terminals in FIG. 4.

Based on these observations, the investors have developed a method 200 to reduce the mating force required on the initial connection of male and female connectors 110, 120 of the sealed electrical connector assembly 100.

Figure 5:
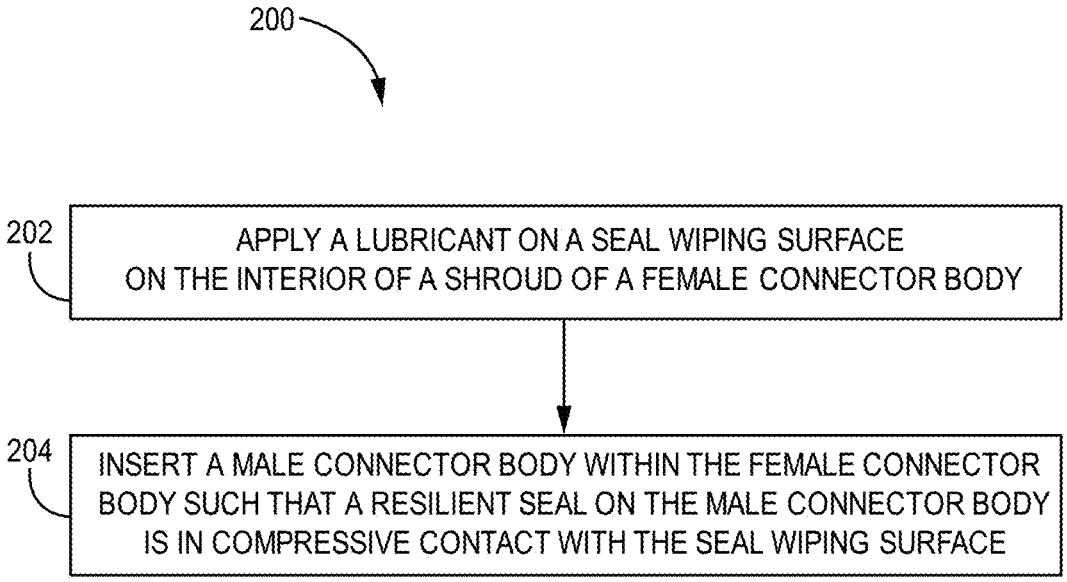
FIG. 5 is a flow chart of a method of treating a seal wiping surface of the sealed electrical connector assembly of FIG. 1 to reduce initial insertion force, according to a first embodiment.

FIG. 5 illustrates an example of a method 200 of preparing the sealed electrical connector assembly 100 for initial connection according to one embodiment of the invention. The method 200 includes the following steps:

STEP 202, APPLY A LUBRICANT ON A SEAL WIPING SURFACE ON THE INTERIOR OF A SHROUD OF A FEMALE CONNECTOR BODY, includes applying a lubricant 152 on a seal wiping surface 128 on the interior of the shroud 124. The lubricant 152 must compatible with both the polymer material forming the male and female connector bodies 112, 122 as well as the silicone-based material forming the seal 114. The lubricant 152 may be a dry film lubricant. The lubricant 152 may be a perfluoropolyether (PFPE) based lubricant, such as OSIXO® manufactured by H. Costenoble GmbH & Co. KG of Eschborn, Germany. The lubricant 152 may alternatively be a phenylmethyl polysiloxane based lubricant, such as DOWSIL™ 550 Fluid manufactured by the Dow Chemical Company of Midland, Mich. Application of the lubricant 152 is preferably limited to only the seal wiping surface 128 so as not to risk contamination of the electrical terminals by the lubricant 152. The lubricant 152 is preferably applied to the seal wiping surface 128 using a spraying process which incorporates a specially designed tool 300 (see FIGS. 6-10) to limit application of the lubricant 152 to only the seal wiping surface 128; and STEP 204, INSERT A MALE CONNECTOR BODY WITHIN THE FEMALE CONNECTOR BODY SUCH THAT A RESILIENT SEAL ON THE MALE CONNECTOR BODY IS IN COMPRESSIVE CONTACT WITH THE SEAL WIPING SURFACE, includes inserting the male connector body 112 within the female connector body 122 such that the seal 114 is in compressive contact with the seal wiping surface 128. The step (STEP 202) of applying the lubricant 152 on the seal wiping surface 128 is performed prior to initial insertion (STEP 204) of the male connector body 112 into the female connector body 122.

Figure 6:
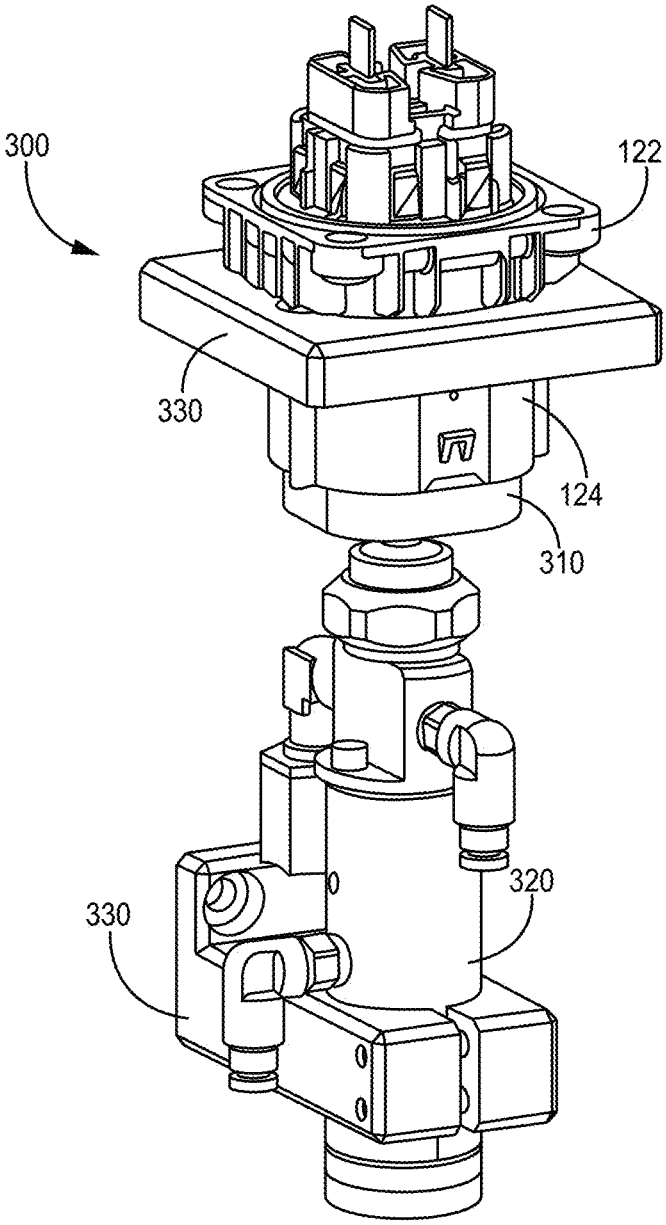
FIG. 6 is a perspective view of a tool configured to treat the seal wiping surface of the sealed electrical connector assembly of FIG. 1 to reduce initial insertion force, according to a second embodiment.

FIG. 6 illustrates an example of a tool 300 configured for preparing the sealed electrical connector assembly 100 for initial connection according to one embodiment of the invention. The tool 300 is configured to spray a fine mist of the lubricant 152 onto the seal wiping surface 128 of the shroud 124 as shown in FIG. 2 while avoiding application of the lubricant 152 to other portions of the female connector 120, particularly the terminals.

As shown in FIG. 6, the tool 300 includes an insert 310 that is received within the shroud 124 of the female connector body 122, a spray valve 320, such as a 781S Spray Valve distributed by Nordson Corporation of Westlake Ohio, that is received within the insert 310, and fixtures 330 for holding the female connector body 122 and spray valve 320 in place.

Figure 7:
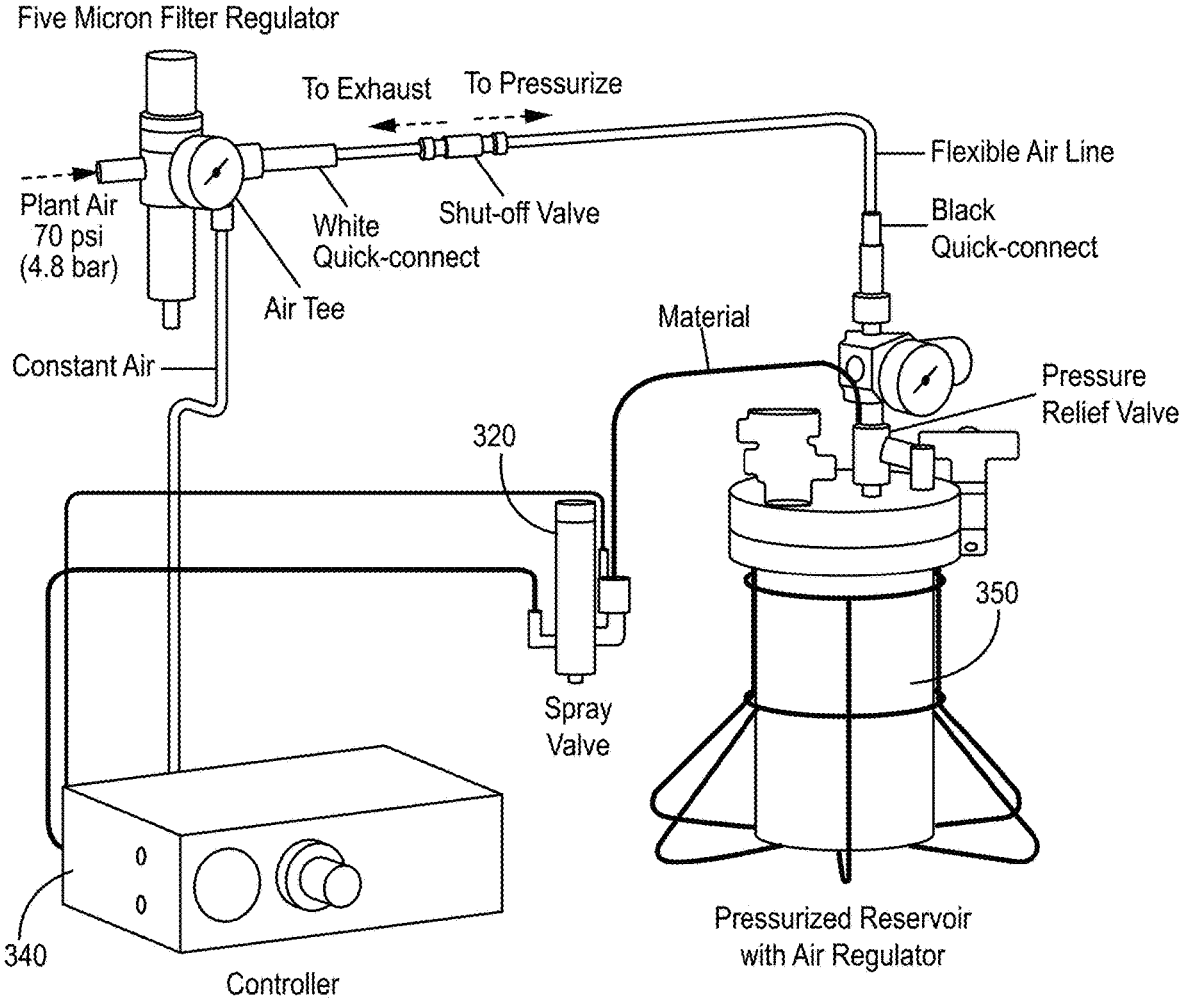
FIG. 7 is a schematic system view of the tool of FIG. 6, according to the second embodiment.

As shown in FIG. 7, the tool 300 further includes a controller 340, such as a VALVEMATE™ controller also distributed by Nordson Corporation, that regulates the air supply to the spray valve 320 and a reservoir 350 that supplies the lubricant 152 to the spray valve 320. The spray valve 320 produces a fine mist of lubricant 152 that is applied to the seal wiping surface 128 through the insert 310.

Figure 8:
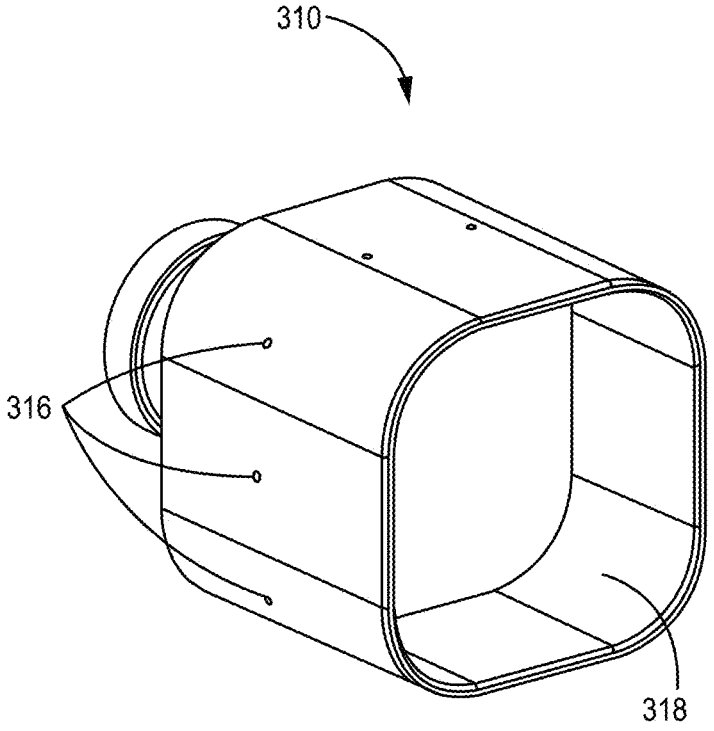
FIG. 8 is a perspective front view of an insert of the tool of FIG. 6, according to the second embodiment.
Figure 9:
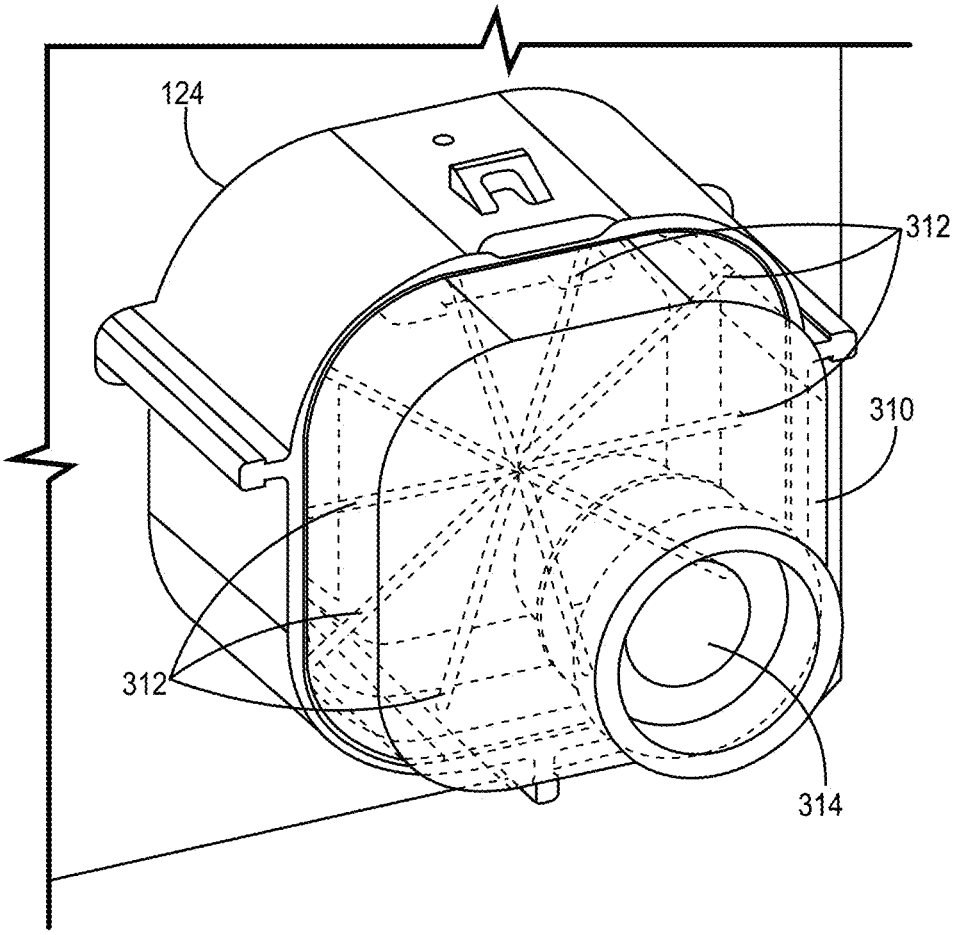
FIG. 9 is a perspective semi-transparent rear view of the insert of FIG. 8, according to the second embodiment.
Figure 10:
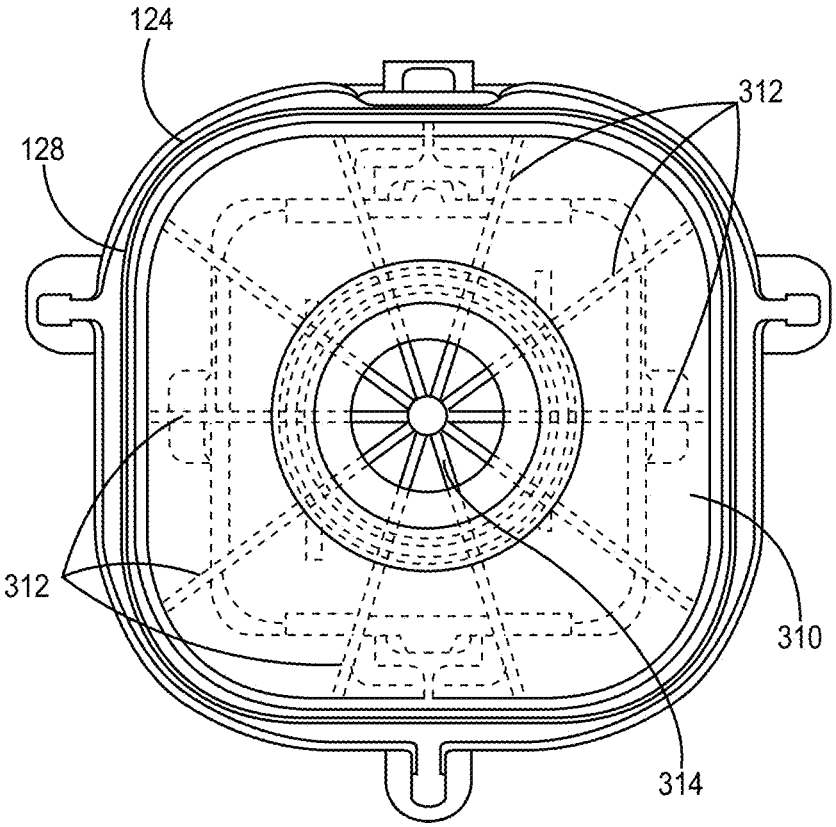
FIG. 10 is a semi-transparent rear view of the insert of FIG. 8, according to the second embodiment.

As shown in FIGS. 8-10, the insert 310 defines a plurality of passages 312 extending radially from a central cavity 314, in which the spray valve 320 is disposed, to portals 316 on the external surfaces of the insert 310. These portals 316 direct the fine mist of lubricant 152 from the spray valve 320 to the seal wiping surface 128 of the shroud 124. The insert 310 also defines an upper cavity 318 in which the terminals of the female connector 120 are received to protect them from lubricant contamination.

Accordingly, a method 200 of preparing the sealed electrical connector assembly 100 for initial connection and a tool 300 for performing the method 200 is provided. The method 200 provides the benefit reducing the initial mating force required to mate the male connector 110 with the female connector 120 to levels comparable with the mating force required for subsequent connections where the seal 114 is made of a high oil bleed connect silicone material. The resultant reduction in friction also decreases the likelihood of bunching, pinching, or rolling of the seal 114 during mating of the male connector body 112 with the female connector body 122 that could cause a leak path past the seal 114. The tool 300 provides the benefit of applying the lubricant 152 only to the seal wiping surface 128 of the shroud 124.

The example presented herein is directed to a method 200 and tool 300 for treating a sealed electrical connector assembly 100 to reduce mating force on initial connection, however other embodiments of the method may be envisioned that are adapted for treating sealed connectors used with connectors of fiber optic cables, pneumatic tubes, or hydraulic tubes.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A tool configured for preparing a sealed electrical connector system for connection, said sealed electrical connector system comprising a male electrical connector body, a female electrical connector body defining a shroud configured to receive the male electrical connector body, and a resilient seal arranged intermediate the male electrical connector body and the female electrical connector body, said tool comprising:

an insert defining a central cavity and a plurality of passages extending from the central cavity to portals defined in an outer surface of the insert; and a spray valve disposed within the insert configured to dispense a lubricant mist into the central cavity and through the plurality of passages to the portals, wherein the insert further defines an upper cavity separate from the central cavity configured to receive terminals in the female electrical connector body and protect the terminals from the lubricant mist.

2. The tool according to claim 1, wherein the insert is configured to be disposed within the shroud.

3. The tool according to claim 1, wherein the portals are configured to deposit the lubricant mist onto a seal wiping surface of the shroud.

4. The tool according to claim 3, wherein the insert is configured to limit application of the lubricant mist to the seal wiping surface.

5. The tool according to claim 1, wherein the insert and the spray valve are configured to accommodate a perfluoropolyether based lubricant.

6. The tool according to claim 1, wherein the insert and the spray valve are configured to accommodate a phenylmethyl polysiloxane based lubricant.

7. The tool according to claim 1, wherein the resilient seal axially surrounds a portion of the male electrical connector body.

8. The tool according to claim 1, wherein the spray value is connected to an air supply and a reservoir of lubricant.

9. The tool according to claim 8, further comprising a controller configured to regulate the air supply to the spray valve.

10. The tool according to claim 1, wherein the lubricant mist is a fine mist.

11. A tool for applying a lubricant to a shroud of an electrical connector, said tool comprising:

an insert defining a central cavity and a plurality of passages extending from the central cavity to portals defined in an outer surface of the insert; and a spray valve disposed within the insert and configured to dispense a lubricant mist into the central cavity that migrates through the plurality of passages to the portals and is deposited onto an inner surface of the shroud, wherein the insert further defines an upper cavity separate from the central cavity and configured to receive terminals in the electrical connector body and protect the terminals from the lubricant mist.

12. The tool according to claim 11, wherein the insert is configured to be disposed within the shroud.

13. The tool according to claim 11, wherein the insert is configured to limit application of the lubricant mist to the inner surface of the shroud.

14. The tool according to claim 11, wherein the insert and the spray valve are configured to accommodate a perfluoropolyether based lubricant.

15. The tool according to claim 11, wherein the insert and the spray valve are configured to accommodate a phenylmethyl polysiloxane based lubricant.

* * * * *